United States Patent [19]

Malin

[11] Patent Number: 4,544,323

[45] Date of Patent: Oct. 1, 1985

[54] QUICK COUPLING AND LIFT DEVICE

[76] Inventor: James I. Malin, 3790 Woodman Dr., Troy, Mich. 48084

[21] Appl. No.: 414,643

[22] Filed: Sep. 3, 1982

[51] Int. Cl.[4] ..... B66F 9/075

[52] U.S. Cl. ..... 414/785; 187/9 R

[58] Field of Search ..... 787/9 R; 414/785, 607; 403/353; 187/1 R, 9 E

[56] References Cited

U.S. PATENT DOCUMENTS

| | | | |
|---|---|---|---|
| 2,456,320 | 12/1948 | Repke | 414/785 X |
| 2,701,658 | 2/1955 | Radin et al. | 414/607 |
| 4,136,792 | 1/1979 | Wilson | 403/353 X |
| 4,342,377 | 9/1982 | Goodwin | 414/785 X |

FOREIGN PATENT DOCUMENTS

| | | | |
|---|---|---|---|
| 1530628 | 5/1968 | France | 414/785 |
| 2091210 | 7/1982 | United Kingdom | 187/9 E |

*Primary Examiner*—Joseph J. Rolla
*Assistant Examiner*—Nils E. Pedersen
*Attorney, Agent, or Firm*—Thomas M. Scofield

[57] ABSTRACT

The invention concerns improvements in universal vertical lift system couplings and attachments therefor; in vertical lift systems, improvements in wide engagement and narrow engagement universal couples and attachments; and improvements in couples of vertical lift systems, both wide gauge and narrow gauge, which permit attachment engagements be fixed directly to the working attachment member, rather than requiring the conventional intermediate universal support or carry.

68 Claims, 15 Drawing Figures

QUICK COUPLING AND LIFT DEVICE

BACKGROUND OF THE INVENTION

Industrial trucks, carriers, movers and lifts of all sort have been adapted to have removably engaged therewith or removably mounted thereon the widest variety of working or lifting attachments. These include, without limitation, and only as a suggestion of the multiplicity of variety of such working attachments: carton clamps, pushers and push/pulls, load clamps, rotators, including those up to 360 degrees, fork positioners, side shifters, paper roll clamps, drum handlers and the like. Additionally, reach attachments, box dumpers, booms, car breakouts and the like may be added to this list.

For these many and varied working attachments, a number of mountings and quick attach/detachment arrangements have been provided. These devices typically involve the laterally sliding on and off of the working attachment with respect to normally horizontal carrier beams or a hook-over arrangement involving snap locks. In most cases, either the working operator must get off the vehicle and effect a sliding of the attachment on or off carrier beams or an intricate extendable and retractible coupler means has to be provided to permit the required engagement and disengagement.

It would be most useful to provide a quick couple construction for a vehicle which is readily and securely engageable with the work attachment and readily disengageable therefrom, but which does not require an extendable and retractible complex coupling means on the front of the vehicle, or does not require the individual operator to dismount to remove the attachment from the couple by sliding disengagement. Yet further, it is important to provide, in any vertical lift system, a minimum spacing or distance between the work attachment engaged and the couple for center of gravity and work space purposes. Still further, in most vertical lift systems, including those involving a multisegment mast arrangement, the provision of the couple-attachment engagement at or behind the contacting areas of the couple and work attachment would be a great advantage and improvement, not only with respect to space in storage, handling and work, but also with respect to security of engagement and optimum positioning of the center of gravity with respect to the lift system and mast or axis of lift.

What is basically desirous, and is not provided by the prior art, is a couple in a vertical lift system, the vertical lift system either static or mobile, where the engagement with the work member is behind the abutment interface of the lift element contacting the work attachment and the rear or abutting face of the work attachment. When a mobile system of this sort is provided, so long as the couple engagement zones are lower than the attachment engagement areas, the vehicle may be driven up to the work attachment, which is positively engaged by the couple simply by lifting a portion of the vertical lift system and without any requirement on the operator of leaving the driver's seat. In changing attachments again, the vehicle merely needs to be driven to the desired storage zone, the attachment lowered to the ground and, thereafter, the couple engagement members lowered below the level of the engagement means on the attachment. This type of disengagement permits the vehicle to back away and freely move to the next working attachment for engagement therewith.

OBJECTS OF THE INVENTION

A first object of the invention is to provide new and valuable improvements in couples and attachments for vertical lift systems, both static and mobile .

Another object of the invention is to provide improvements in couples and attachments for vertical lift systems utilizing vertical masts or hoist guide frames of conventional type, where the mast elements or hoist guide frame elements comprise configured frame plates adapted to be elevated and lowered in sequence within the lift frame at the will of the operator through a suitable conventional lifting power mechanism and control therefor.

Another object of the invention is to provide such improvements in couples and attachments which will permit all the multiplicity of standard work attachments, such as forks of all types, side shifters, clamps of all types, rotators of all types, positioners of all types, pushers and push/pulls of all types, etc. to be directly coupled with lift elements which are directly carried by the working elements of standard lift assemblies, either mobile or static, without the requirement of intermediate structure.

Another object of the invention is to provide such couple improvements which also include optional lower level locking systems to safeguard carrying and movement of heavy loads and working attachments in mobile uses, as well as uses which require fixed attachments to the couple at a multiplicity of levels.

Still another object of the invention is to provide simple, relatively inexpensive, extremely rugged improvements in couples and attachments for engagement therewith which may be manufactured new, retrofitted in the field or provided as options by the manufacturers and merchandisers of attachments and lift systems.

Another object of the invention is to provide such improvements in couples and attachments engageable therewith wherein all parts of the engageable means between the couple and atachments are (before engagement) readily and fully available to view to readily ascertain the status of the elements as to repair, cleanliness, orientation and operability.

Another object of the invention is to provide devices of the character described wherein the vehicle or lift operator may change attachments without leaving the seat of the vehicle and, in fact, without the requirement of any additional mechanized equipment to perform such changes, in most cases, with very few exceptions.

Still another object is that the subject novel attachments, when picked up, can automatically be locked onto the lift mechanism and unlocked by simply putting the attachment down again.

Another object of the invention is to provide improvements in couple mechanisms which may be applied to or made integral with the standard guide plates of conventional mast constructions, hoist guide frames of conventional construction or vertical lift hoists of conventional construction where guide plates and one or more associated sets of configured frame plates are normally nested and engaged together in a group in a frame and elevatable and lowerable in regular sequence within the frame at the will of an operator through suitable conventional lifting power mechanisms and controls including cable lifts, chain lifts, hydraulic cylinders and the like, all of known and commercial type.

Other and further objects of the invention will appear in the course of the following description thereof.

IN THE DRAWINGS

In the drawings, which form a part of the instant specification and are to be read in connection therewith, embodiments of the invention are shown and, in the various views, like numerals are employed to indicate like parts.

FIGS. 1–5, inclusive illustrate a first embodiment of the improved couple-attachment assembly. The vertical lift system employed in the embodiment of these figures is a conventional vertical lift hoist, hoist guide frame or vertical mast assembly wherein central guide plates move upwardly and downwardly within configured, nesting beams or frame members driven by conventional lift power mechanisms such as one or more hydraulic cylinders or cables. The lift hoist or mast system may be statically mounted or on a vehicle in conventional manner. The outlying elements of the lift hoist or mast system are shown in dotted lines, being conventional, as is the hydraulic cylinder.

FIG. 1 is a top plan view of a wide gauge couple-attachment system with the couple and the guide plates carrying same shown in full lines in the top portion of the view and the attachment in full lines in the bottom portion of the view.

FIG. 2 is a side elevation of the couple and attachment of FIG. 1. The dotted line showing of the couple (in the left hand portion of the view) again illustrates the elements of the vertical mast system and, additionally, a wheel as in a typical vehicle mounting is shown. Also seen in dotted lines on the couple in the left hand part of the view is the lower lock mechanism. In the right hand portion of the view the attachment is shown in full lines with details of structure thereon for the engagement shown in dotted lines and also typical conventional lift hooks engageable with the basic attachment beam structure shown.

(In the views of FIGS. 1–5, inclusive, the basic attachment is shown as parallel, normally horizontal, vertically spaced apart engagement bars, which is one basic couple employable on the guide plates of a conventional lift mast system. However, these beams could be the frame or back wall of any working attachment such as those previously listed.)

FIG. 3 is a front elevation of the couple seen in the upper portion of FIG. 1 and left hand portion of FIG. 2, in full lines in each case. Again, the dotted line showing is a representation of the typical lift assembly elements which may be associated therewith of the type seen in previous figures. This elevation is a view of the couple taken from the center of the view of FIG. 1 looking upward in that view or the center of the view of FIG. 2 looking to the left in that view.

FIG. 4 is a front elevation of the sample attachment seen in the lower portion of FIG. 1 and the right hand side of FIG. 2, the dotted line showing illustrating the fork attachment seen to the right in FIG. 2 and, centrally of the view, an engaging member for the lock mechanism seen in the lower portion of the left hand part of FIG. 2 and lower left center of FIG. 3.

FIG. 5 is a three-quarter, exploded, perspective view of the subject couple and attachment of FIGS. 1–4, inclusive, showing, in the left hand side of the view, the couple associated with the basic guide plates of the vertical lift or mast system (the latter not seen) and, in the right hand side of this view, the sample attachment therefor of the previous figures. In this case, the lift hook (work) elements seen in FIG. 2 and 4 are not shown on the attachment, in order to more clearly show the entire attachment structure.

FIGS. 6–10, inclusive illustrate a modified form of the subject couple and attachment, specifically, the narrow gauge verion thereof, as is exemplified in a vertical lift system of the vertical hoist type or vertical condensing mast system, where configured frame plates and guide plates are adapted to be elevated and lowered with respect to one another in a frame at the will of the operator of the lift system through a suitable conventional lifting power mechanism and controls therefor. In these figures, the guide or lift plates which carry the couple are schematically shown in full lines, with the outer elements of the mast system and hydraulic cylinder power elements therefor shown in dotted lines. In these views, the work attachment, again for simplicity's sake, is shown as a broad, essentially rectangular panel of unitary construction which is engageable by various working attachments such as the lift hooks shown in dotted lines in FIGS. 7 and 9. This panel also represents, schematically, the back side, wall or frame of any standard working attachment.

FIG. 6 is a vertical plan view, from above, of the narrow or short gauge couple (upper portion of the view) with the sample engageable attachment therefor seen in the lower part of the view. Dotted line showings indicate mast elements of conventional type and hydraulic cylinders of a typical lift system.

FIG. 7 is a side elevation of the couple and attachment of FIG. 6 with the couple in the left hand side of the view and the attachment in the right hand side. The dotted line showings are the mast elements of FIG. 6 and a typical vehicle wheel in the left hand side of the view, as well as the locking device. A typical removable lift fork attachment is seen on the panel attachment, in the right hand side of the view, also in dotted lines.

FIG. 8 is a front elevation of the couple seen in the upper portion of FIG. 6 and left hand side of FIG. 7. Dotted line showings are mast frame elements and hydraulic system attachments associated therewith, as well as a base.

FIG. 9 is a front elevation of the sample attachment of the lower portion of FIG. 6 and the right hand side of FIG. 7, the dotted lines showing a removable lift fork attachment therefor and the couple lock engagement centrally of the panel.

Figure 10:
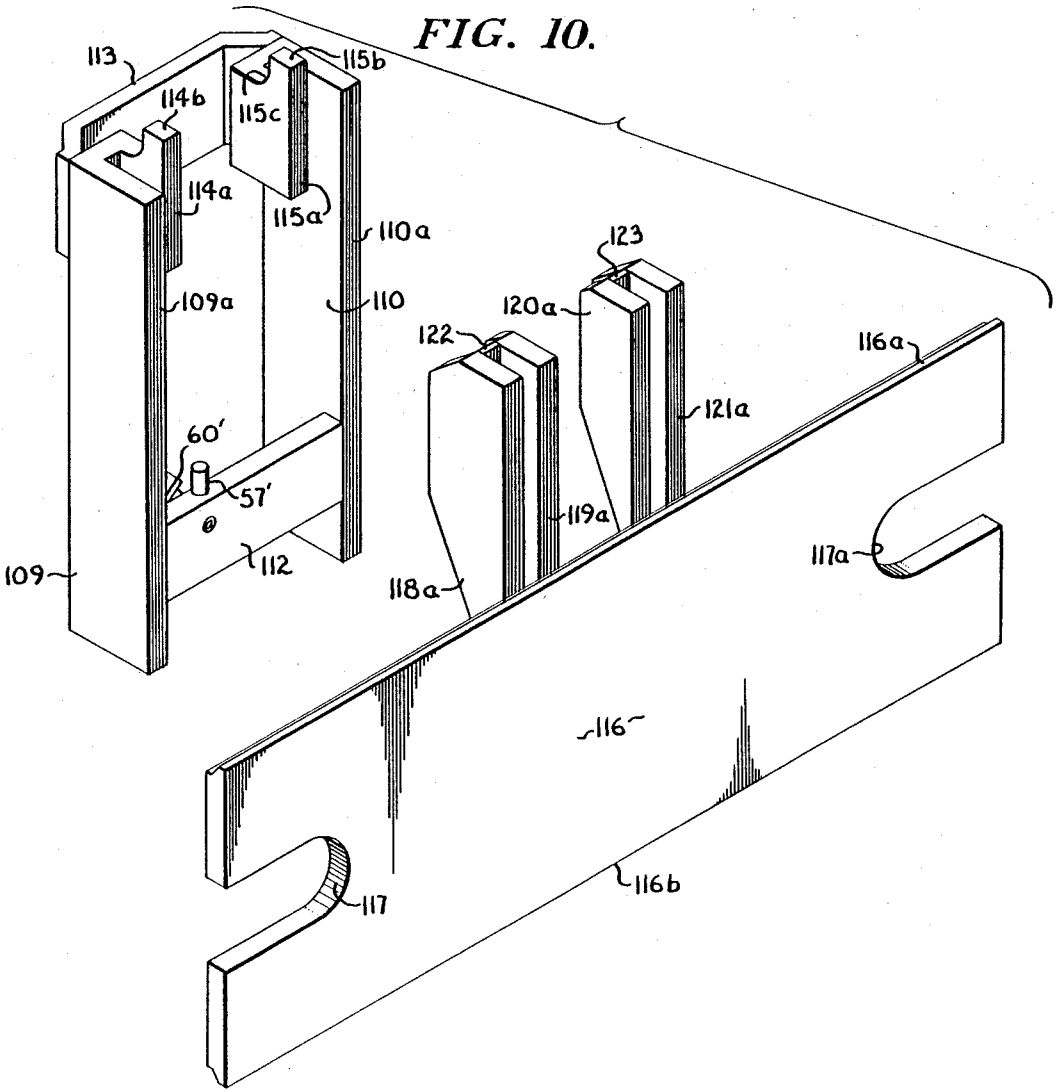

FIG. 10 is a three-quarter exploded perspective view of the couple and sample attachment therefor of FIGS. 6–9, inclusive with the couple in the upper left hand portion of the view and the attachment in the lower right hand portion of the view. For clarity's sake, the mast elements and drivers (hydraulic pistons) therefor have been omitted with respect to the couple and the fork lift attachment with respect to the attachment panel.

Figure 11:
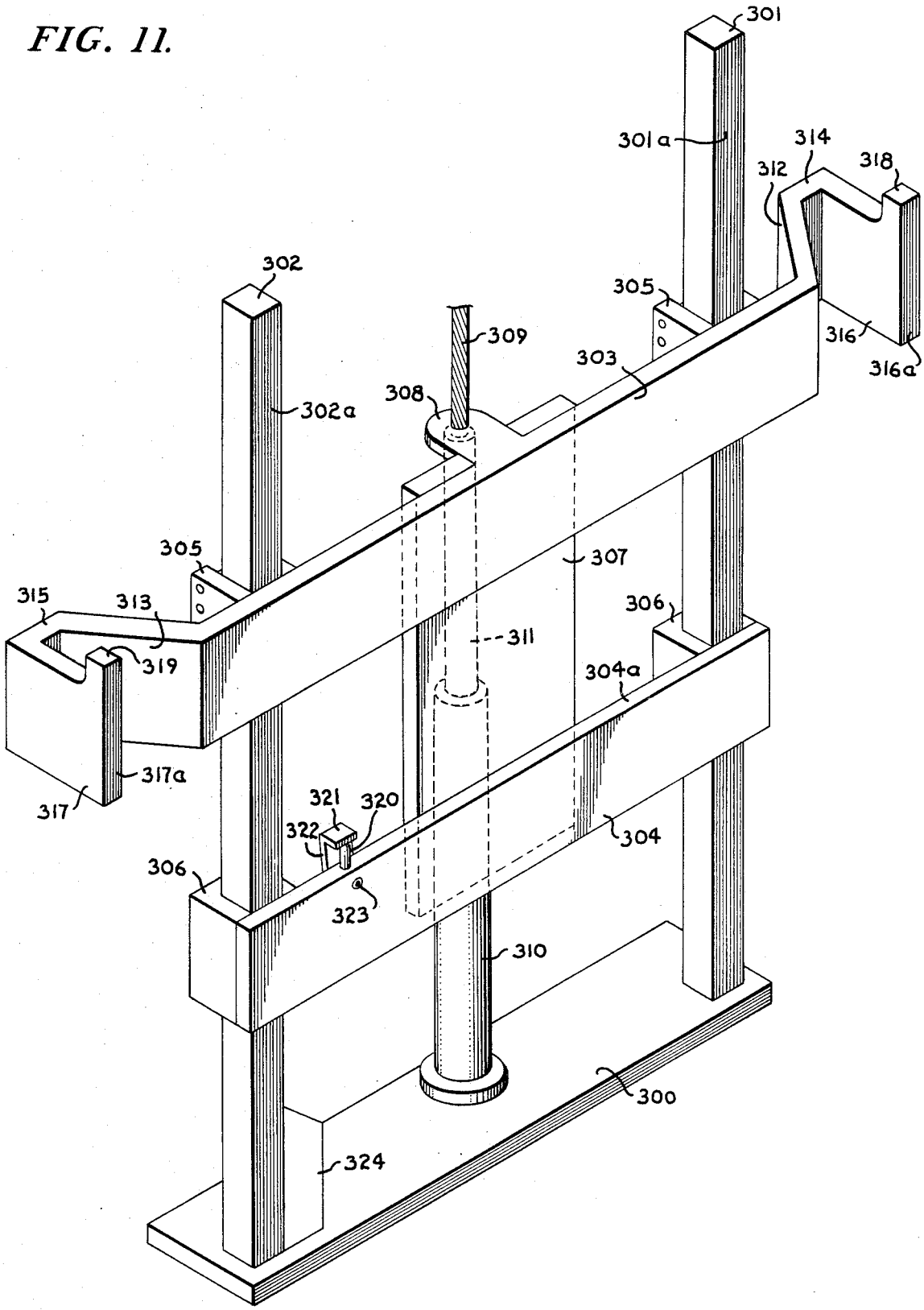

FIG. 11 is a three quarter perspective view, from above, of a couple construction analogous to that seen in FIGS. 1–5, inclusive wherein the mount or base for the couple is a static, vertical lift hoist or frame. The couple in this figure is analogous to that seen in full lines in the top portion of FIG. 1, the left hand side of FIG. 2, FIG. 3 and the left hand side of FIG. 5. (Specifically, that is, it is a wide gauge couple adapted to receive, attach to and detach from and lift and lower attachment such as that also seen in FIGS. 1-5, inclusive, specifically, the lower portion of FIG. 1, the right hand portion of FIG. 2, FIG. 4 and the right hand portion of FIG. 5. Since such attachment would be the same, similar or analogous in structure to that seen in FIGS. 1–5, inclusive, it is not shown in FIG. 11.)

Figure 12:
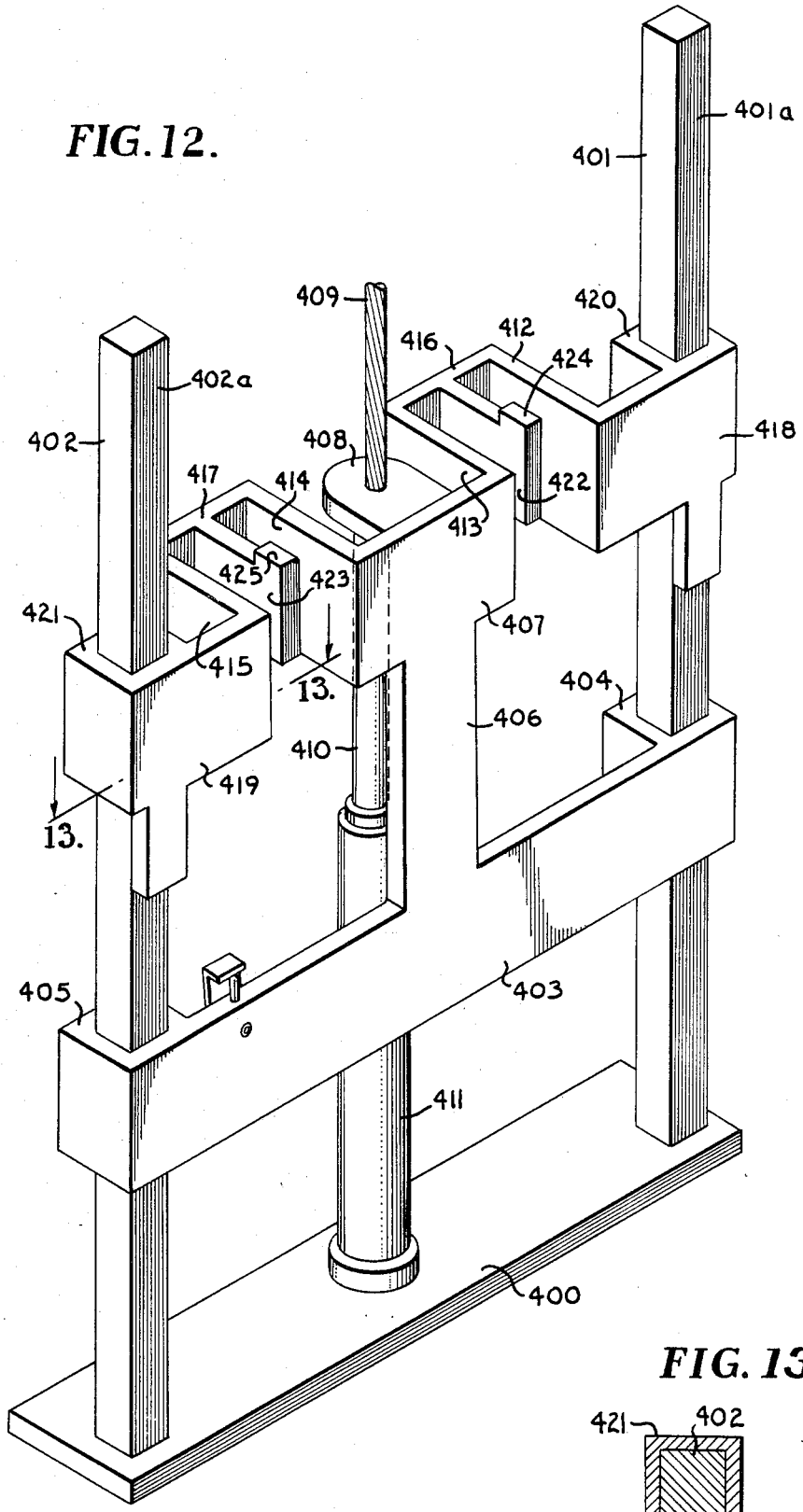

FIG. 12 is a three quarter perspective view, from above, of a couple construction analogous to that seen in FIGS. 6–10, inclusive. (Specifically, that is, this couple is a small gauge or inboard couple like that seen in the upper portion of FIG. 6, the left hand portion of FIG. 7, FIG. 8 and the left hand portion of FIG. 10. However, the said couple is mounted on a static, vertical, double mast system. This couple would be used with an attachment as seen in the lower part of FIG. 6 the right hand side of FIG. 7, FIG. 9 and the right hand side of FIG. 10. Such attachment, being the same, similar or analogous to that seen in FIGS. 6–10, inclusive, is not shown in the view of FIG. 12.)

Figure 13:
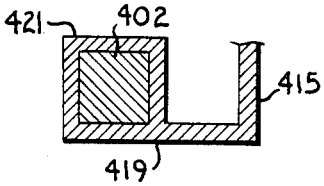

FIG. 13 is a view taken along the line 13—13 of FIG. 12 in the direction of the arrows.

Figure 14:
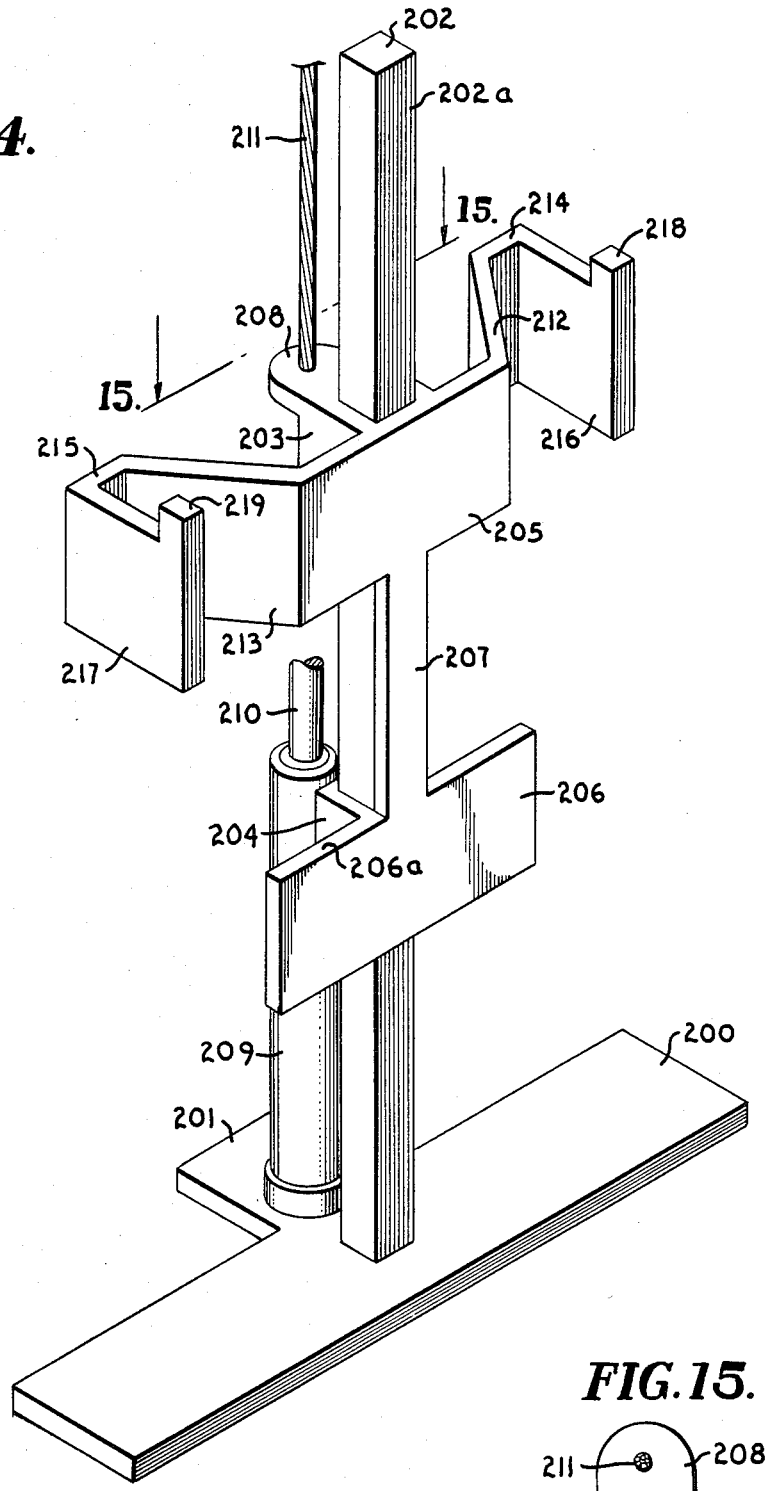

FIG. 14 shows a modified couple associated with a vertical mast support system analogous to those seen in FIG. 11 and 12, but differing therefrom in utilizing but a single supporting mast. (In this construction, the couple may be of a configuration that is wide gauge, as is contemplated in FIG. 11, or narrow gauge, as is contemplated in FIG. 12. The view is a three quarter perpective from the front and above. No associated attachment is seen therewith, but either the attachment seen in FIGS. 1–5, inclusive may be used (if the couple is wide gauge) or the attachment of FIGS. 7–10, inclusive (if the couple is narrow gauge).)

Figure 15:
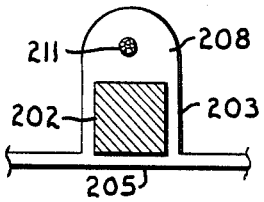

FIG. 15 is a view taken along the line 15—15 of FIG. 14 in the direction of the arrows.

BRIEF DESCRIPTION OF THE INVENTION

In its preferred embodiment, as particularly seen in FIGS. 1–10, inclusive, the subject invention involves a quick lift couple and attachment. The couple construction typically involves or is based on a pair of elongate, normally vertical, couple guide plate beams. These beams are opposed to one another in parallel, spaced apart relationship and typically are substantially rectangular in side, front and plan views. The beams have forward and rearward edges, top and bottom ends and inboard and outboard elongate flat faces. A lower, normally horizontal, couple stabilizer beam typically extends between the opposed inboard faces of the couple guide plate beams adjacent the lower ends thereof and is connected thereto with the beam ends near to the guide plate beam's front edges so that one surface of the stabilizer beam is substantially in line therewith.

Each guide plate, adjacent its top ends, has mounted adjacent thereto a secondary beam member which extends normally vertical and subtantially parallel to the guide plate. The respective secondary beam members and guide plates are rigidly secured to one another adjacent one vertical edge of the guide plate and one vertical edge of the secondary beam member. An upper, normally horizontal couple stabilizer beam typically extends between the couple guide plates at an upper level thereof and is connected thereto with its ends.

The attachment to the couple is, typically, a work piece member having a normally vertical rear or rearward wall or face of such dimension as to be able to extend between and across and be able to abut against the forward edges of the couple guide plates below their upper ends. Two normally vertical work piece support plates are typically fixed to the rearward face of the work piece member and extend normal thereto. Means are provided cooperating between the secondary beam members and work piece support plates for removably engaging the one with the other behind the forward edges of the couple guide plates. When this engagement is made, raising and lowering the couple guide plate beams will raise and lower the attached work piece member.

In a broad gauge or greater width verion of the couple and attachment, the secondary beam members are positioned outboard of the couple guide plate beams. They may be part of an integral couple top support beam fixed to the front edges of the couple guide plate beams, adjacent the top ends thereof. In this case, the work piece support plates are further spaced apart from one another. Alternatively, the secondary beam members may be positioned inboard of the couple guide plate beams in a narrow gauge application. In such case the work piece support plates engageable therewith are closely spaced together on the work piece member.

Engageable and disengageable locking means are optionally provided which will cooperate between the rearward face of the work piece member and a portion, typically the top edge thereof, of the lower couple stabilizer beam for providing a second engagement of the work piece below the upper engagement for rigidity and stability.

The secondary beam members are preferably single members which are embraced by sets of normally vertical, paired work piece support members fixed to the rearward face of the work piece member and extending normal thereto. This engagement construction provides great strength and stability in all dimensions, with respect to the latter particularly when the lower locking means is provided.

FIGS. 1–5, INCLUSIVE

FIGS. 1–5, inclusive show a broad gauge or wide couple and attachment construction. The lift couple, which may be either static or mobile, is of conventional design and certain operative parts thereof are shown in dotted lines, schematically. These comprise normally fixed, static channel members 30 and 31 which are normally vertical. These channel members are essentially foreshortened C sections as illustrated and are rigidly tied to the base of the vehicle or support. The latter is normally horizontal and seen only in FIG. 3 at 32. Nested within channel member 30 and 31 are J section members 33 and 34 which are vertically movable with respect to base or floor 32 and the fixed channel members 30 and 31. Rollers 35 are mounted on either J section members 33 and 34 or channels 30 and 31 (or both). An hydraulic cylinder 36 having vertically movable piston rod 37 is provided, preferably centrally of channels 30 and 31. The structures just described are conventional in the prior art. The base or floor 32 may be carried by wheels 38 (FIG. 2) or be statically positioned or yet represent a floor itself.

The subject improved couple construction, as seen in FIGS. 1–5, inclusive, is based upon elongate, normally vertical, generally substantially rectangular, couple guide plate beams 39 and 40. Rollers 41 are typically rotatably mounted on the outer faces of beams 39 and 40 and serve to permit the guide plate beams 39 and 40 to move upwardly and downwardly within J sections 33 and 34, as rollers 35 permit J sections 33 and 34 to move upwardly and downwardly within channels 30 and 31. Beams 39 and 40 are tied together adjacent the lower ends thereof by lower, normally horizontal couple stabilizer beam 42 extending between the opposed, inboard faces of the couple guide plate beams and connected thereto with its ends near to the guide plate beam front edges so that, preferably, the front or outboard surface of stabilizer beam 42 is substantially in line with the front edges 39*a* and 40*a* of guide plate beams 39 and 40. An upper beam member centrally designated 43 is rigidly welded or otherwise fixed to the upper front edges of beams 39 and 40 and extend therebetween.

By virtue of beams 42 and 43 rigidly locking vertical guide plate beams 39 and 40 together in a vertical, parallel relationship, beams 39 and 40 move vertically upwardly and downwardly as a single unit. Guide plate beams 39 and 40, J sections 33 and 34 and channel sections 30 and 31 operate in conjunction with one another as a lift mast system. The hydraulic cylinder 36 may be tied to the J sections by a transverse member (not seen) between the rearward ends thereof, in which case the guide plate beams 39 and 40 may be raised, lowered and manipulated with respect to the J sections by means of a conventional chain wheel drive (not shown). Alternatively, a secondary cylinder (not shown) may be provided coupled with beam members 39 and 40 to move said beams up and down with respect to the J section members 33. This second cylinder may be a short cylinder and carried by the J section members. Alternatively, the cylinder 36 may be coupled by its piston rod directly to beams 39 and 40 to lift them within J section members 33 and 34 and also the J section members with respect to the channels 30 and 31 by a beam member (not shown) between the rearward upper ends of beams 39 and 40. In this case and in other described cases, suitable stops are provided with respect to the roller 41 with respect to J members 33 and 34 and rollers 35 with respect to the J members 33 and 34 stationary channels 30 and 31.

Said otherwise, the drive means to raise and lower the lift mast elements with respect to one another and the base are conventional and may be of various sorts, types and structures. The roller, guide and stop means between the mast elements permitting telescoping raising and lowering thereof are also conventional and may be of various known structures. None of these are detailed.

Various other described options of conventional mast design may be employed. Thus, the guide plates 39 and 40 may be directly positioned within stationary channels 30 and 31. Alternatively, additional mast sections other than guide beams 39 and 40 and J sections 33 and 34 may be provided for various high lift applications. In such cases, suitable conventional engagements between the various channels or members of the mast with respect to one another may be provided, with various conventional roller mountings and stops provided between the channels and mast sections with respect to one another. Various combinations of lift means may additionally be provided for the various sections of the mast with respect to one another. With respect to the sample mounting shown, preferably, beams 39 and 40 may move vertrically within J sections 33 and 34 and the latter vertically within stationary channels 30 and 31. Suitable power drives (typically hydraulic cylinders) are provided connected to the various movable sections of the mast to achieve the lift perameters desired and designed for.

Each guide plate beam 39 and 40 has mounted adjacent thereto a secondary beam member (here members 44 and 45 positioned outboard of beams 39 and 40). The respective secondary beam members 44 and 45 and guide plates 39 and 40 are rigidly secured to one another adjacent one vertical edge (here the front or forward edges) of beams 39 and 40 and one vertical edge (here the rear edges) of secondary beam members 44 and 45. The securements in this case comprise arcuate extensions 43*a* and 43*b* of upper beam 43, which extensions fair rearwardly of the front edges of beams 39 and 40 sufficiently so that the forward edges 44*a* and 45*a* of the secondary beam members 44 and 45 are positioned in line with or behind the forward edges of beams 39 and 40. The top rearward edges of secondary beam members 44 and 45 are preferably in line with the top of beam 43, while raised forward portions 44*b* and 45*b* are provided thereon extending above the top edge of beam 43 which have arcuate rearward bearing edges 44*c* and 45*c*.

In conventional use of guide plates 39 and 40 in the prior art, typically, a pair of horizontal, vertically spaced apart beam members (the conventional usage is not shown) are fixed to the forward edges of the guide plates. These beam members have elongate, flanged upper and lower edges for sliding engagement onto the beams and removal therefrom of work members of various sorts, including forks and the other work members previously listed above (rotators, clamps, etc.). To permit such engagement, the work member rear faces must have spaced, horizontal, matching flanges mounted thereon slideably engageable with the beam upper and lower edges.

In the specific showings of FIGS. 1-5, inclusive, such universal mounting, horizontal beam members are shown as they would be mounted on the subject couple, although, since the subject is itself a universal mounting, this would be a very unusual application. However, the simplicity of this well known attachment, and its structure, permits a good illustration of a sample work attachment and how same would be engaged with and disengaged from the subject couple carried by conventional couple guide plate beams 39 and 40.

Figure 1:
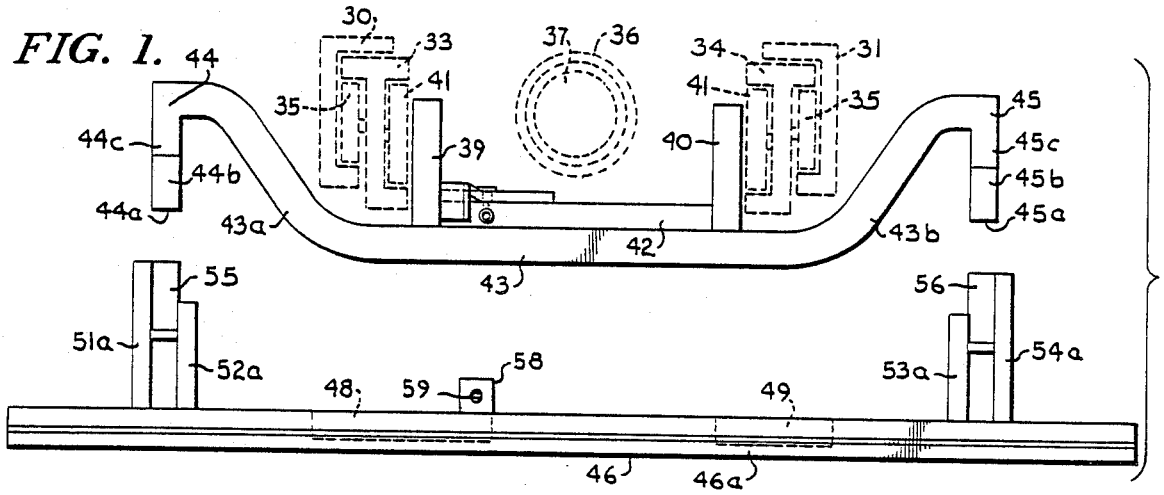
Figure 2:
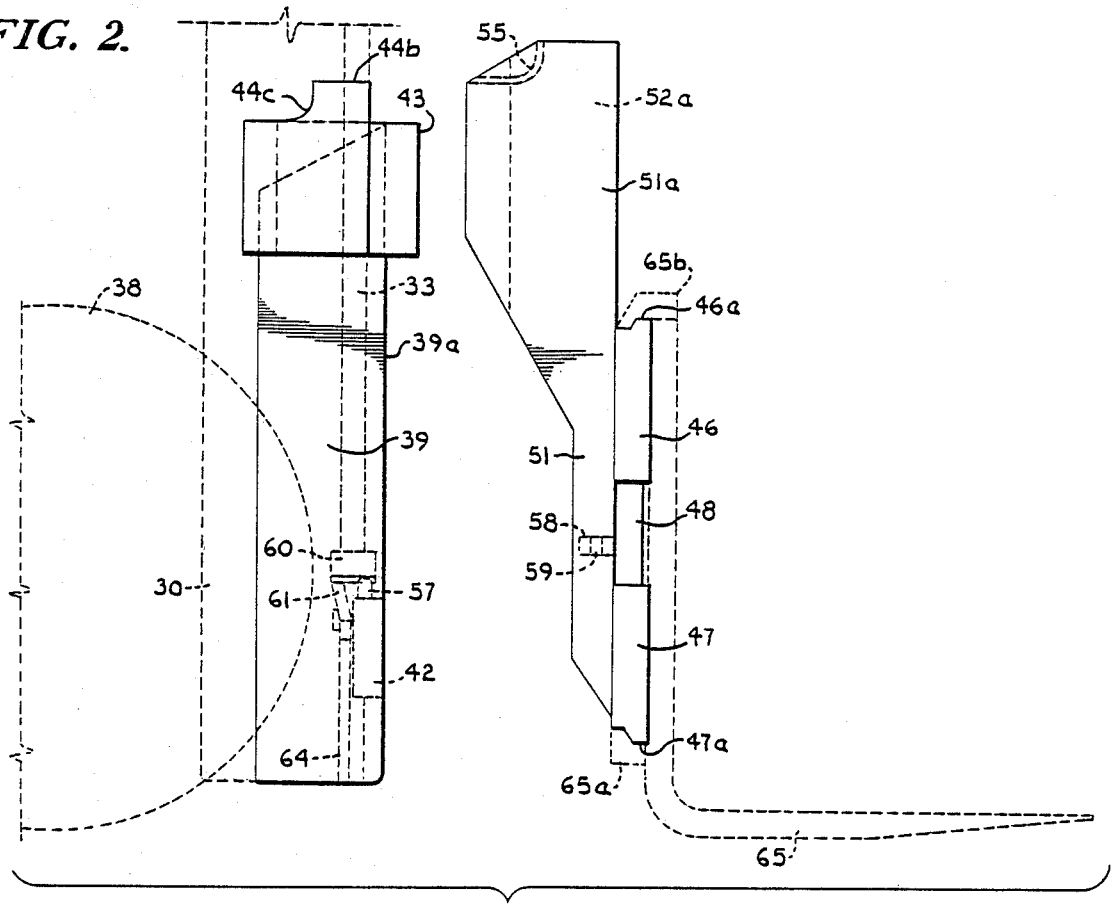
Figure 3:
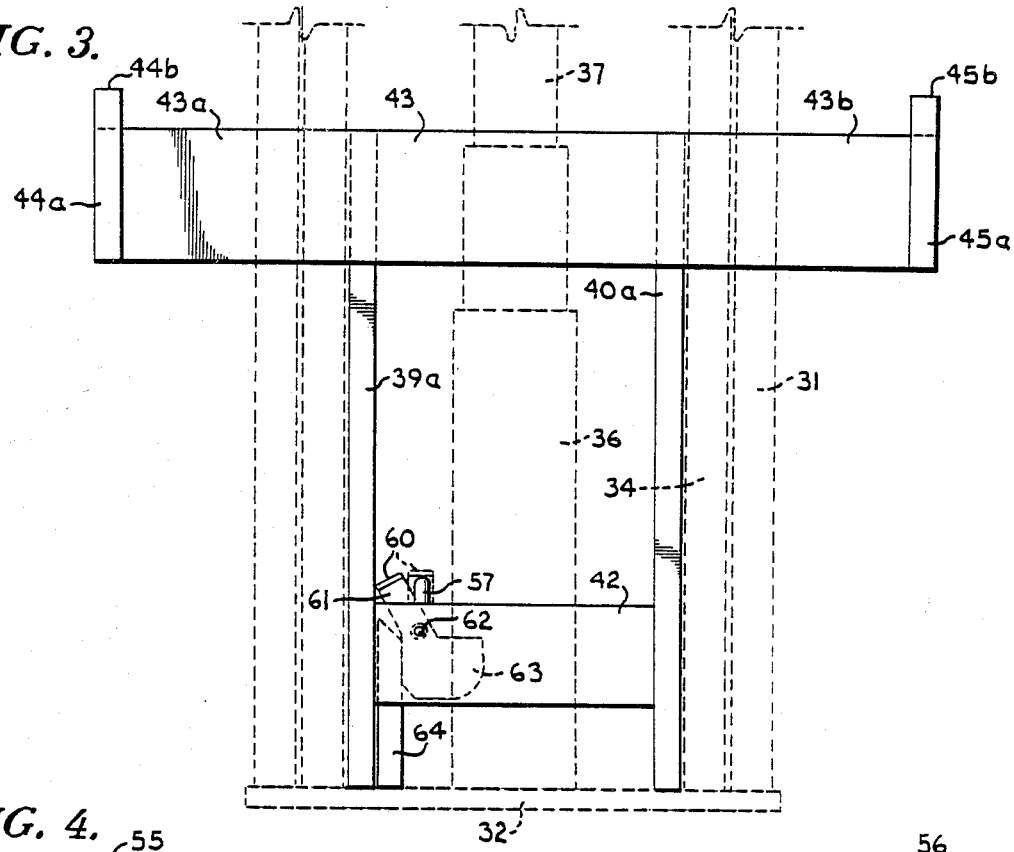
Figure 4:
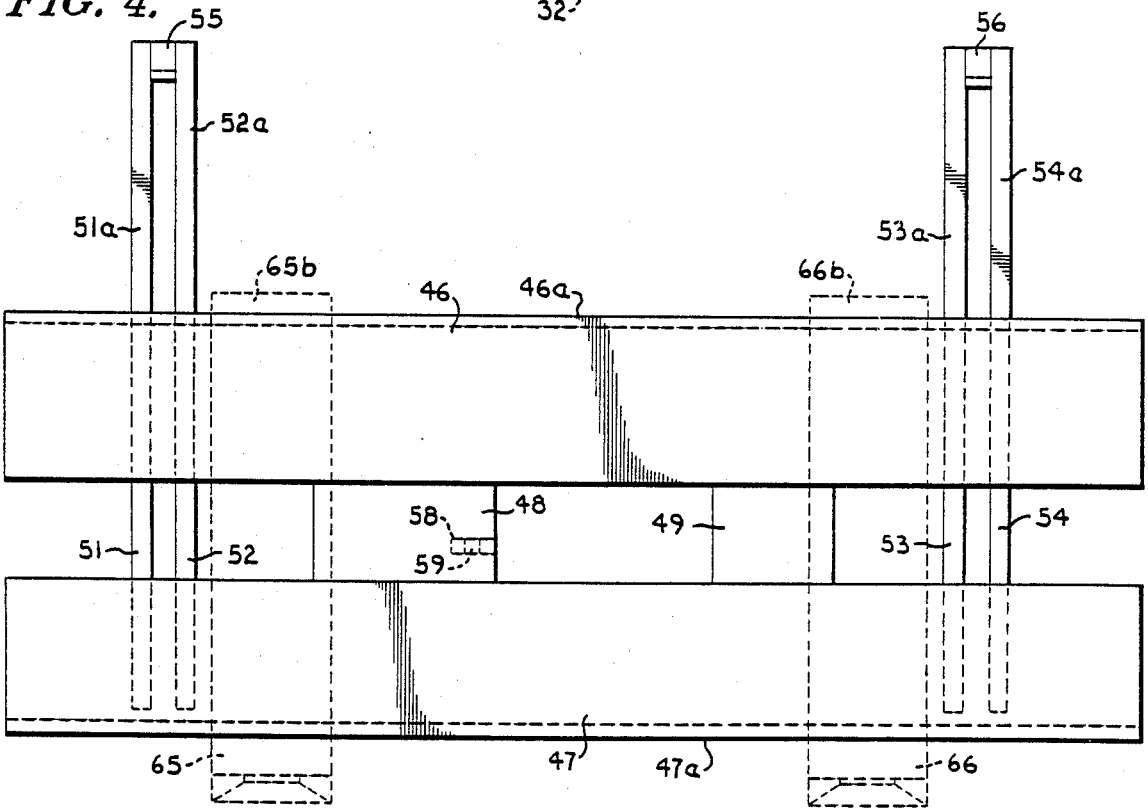
Figure 5:
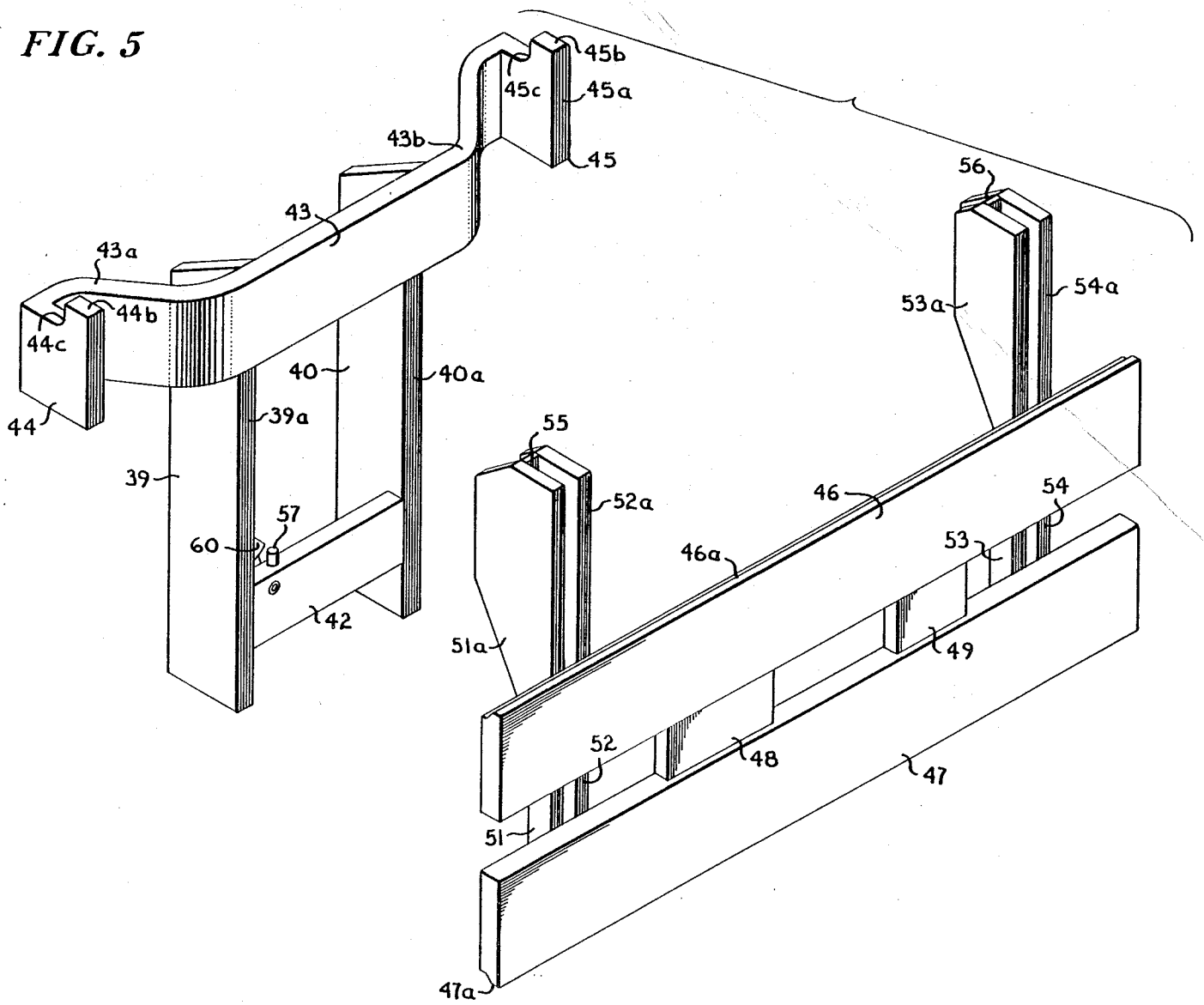

Referring, then, to FIG. 5, particularly for optimum initial visualization, but also to FIGS. 1-4, inclusive, a first, horizontal (normally horizontal) elongate beam 46 is provided, spaced vertically apart above and from lower, normally horizontal beam 47 in normally parallel relationship, two vertical connecting beams 48 and 49 rigidly connect and space apart in parallel, normally horizontal relationship, beams 46 and 47. Beam 46 preferably has top mounting flange 46*a* extending the length thereof and, further, beam 47 preferably has like bottom mounting flange 47*a* on the lower edge thereof for slidable mounting purposes for work attachments, as will be described and is shown in FIGS. 2 and 4. The structure of these beams 46 and 47 is that of those standard, conventional beams making up the art universal mounting system which are generally rigidly fixed to the front edge of guide plate beams 39 and 40 or their equivalents in a standard universal mounting construction of the prior art.

What is required of any work piece member which is to be carried by the couple on beams 39 and 40 is that it have a normally vertical rearward face of such dimension as to be able to extend between and across and be able to abut against the forward edges of couple guide plates 39 and 40 below the couple top support beam 43 in a position normal to the said guide plates 39 and 40. That is, what is desired, for any work piece member (here shown as horizontal beams 46 and 47) is that its rearward, normally vertical face will be carried in abutment against the front edges 39*a* and 40*a* of beams 39 and 40 while the work member is suspended from or carried by the secondary beam members 44 and 45 outboard of plates 39 and 40 once the couple and the attachment are engaged or mated.

In order to provide suitable engaging suspension means for the work member (beams 46 and 47 rigidly joined by attachments 48 and 49), two sets of normally vertical, paired work piece support plates are fixed to the rearward face of the work piece member (beams 46 and 47) extending normal thereto. These work piece support plates are seen in FIGS. 1, 2, 4 and 5 and comprise in the showings of the various views, one set of support plates generally designated 51 and 52 and a second set of parallel, spaced apart, support plates generally designated 53 and 54. The centers of the sets of such work piece support plates 51-54, inclusive, are spaced apart from one another a distance equal to that separating the centers of secondary beam members 44 and 45. The two support plates (51 and 52 of one set and 53 and 54 of the other set) are spaced apart a distance slightly greater than the thickness of the secondary beam members 44 and 45, whereby, when the couple basically including the lift mast with the upper support beam 43 and secondary beams 44 and 45, is moved toward the work piece member rear face, the secondary beam members 44 and 45 may slideably engage between the members 51, 52 and 53, 54 of the support plate.

Connectors generally designated 55 (between plates 51 and 52) and 56 (between plates 53 and 54) are provided at the upper ends of the plate member sets and fixed therebetween of congruent underside configuration to rear surfaces 44*c* and 45*c* of secondary beam members 44 and 45. In view of the fact that the upper portions 51*a*-54*a* of support plates 51-54, inclusive are made deeper (particularly see the upper right hand portions of FIGS. 2 and 5), the upper engaging members 55 and 56 may be so positioned with respect to the rear faces of horizontal beams 47 and 46 (or any equivalent other work member) that, when the rear face of the work member is in abutment against the forward edges 39*a* and 40*a* of beams 39 and 40 under upper cross beam 43, the connectors 55 and 56 may be overlying surfaces 44*c* and 45*c* in tight, congruent, locking engagement.

This engagement is simply provided by lining up the front edges 39*a* and 40*a* of beams 39 and 40 in the mast system parallel to and centered of the ends of the rear faces of beams 46 and 47. In this manner, secondary beam members 44, and 45 may be lined up for engagement between the sets of support plates on the rear face of the work member to be engaged by the couple. This assumes that plates 39 and 40 are in lowered position and engaging members 55 and 56 are high enough to slip over secondary beam portions 44*b* and 45*b*. Such relation permits secondary beam members 44 and 45 to slide between the plates 51-54, inclusive in the portions 51*a*-54*a*, inclusive whereby, when the work member rear face abuts against the guide plate 39 and 40 front faces, guide plates 39 and 40 may be raised by the power of the mast lift system (such as hydraulic cylinder 36) to effect engagements of the upper faces 44*c* and 45 of secondary beam members 44 and 45 with the undersides of configured connectors 55 and 56. Disengagements are made in the opposite fashion with the plates 39 and 49 being lowered so that portions 44*b* and 45*b* may clear under the lowermost portions of connectors 55 and 56 as the vehicle or other transport moves away or to the left in the views of FIGS. 2 and 5.

In many instances, it is desirable or necessary to provide a second engagement (other than that immediately described) between the couple and the work member attachment. The first engagement involves connectors 55 and 56 engaging over surfaces 44*c* and 45*c* at the top in such manner that, if guide plates 39 and 40 move up and down, the work member (beams 46 and 47 as shown) will move upwardly and downwardly therewith. The forward portions of surfaces 44*c* and 45*c* and their engagement with the forward normally vertical portions of connectors 55 and 56, together with back face abutment of the work attachment against the forward edges 40*a* and 39*a* of plates 39 and 40 normally result in a rigid, locking securement. However, in the event that, vehicle orientation or movement should cause the mast system to lean at a substantial angle there may be movement of the suspended work piece away from the back face contact with the front edges 39*a* and 40*a* of beams 39 and 40 even if the upper engagement remains intact. Thus, locking means at a lower level are optionally provided.

In the specific case shown, particularly see the lower left center portions of FIGS. 2 and 3, a pin 57 is provided on top of and to one side of center (preferably) on lower cross beam member 42. When such pin 57 is provided, it is preferred that beam 42 have its forward or frontward face substantially in line with beam edges 39*a* and 40*a*. A flange 58 having a normally vertical passage 59 therethrough of equal or greater inner diameter to the outer diameter or pin 57, is rigidly fixed normal to the back face of the work member, precisely laterally positioned between the sets of support plates 51-54, inclusive and at such a height that, as the underside of the connectors 55 and 56 are lowered into contact engagement with surfaces 44*c* and 45*c*, flange 58 is lowered over pin 57 in close engaging relationship. A pivotal guard or cover adapted to maintain flange 58 on pin 57 except when guide plates 39 and 40 are in the base position of FIG. 3 (where the cover is shown in full line deflected sidewards to permit mounting of flange 58 on pin 57) comprises normally horizontal plate 60 carried by arm 61 which is pivotally mounted at 62 on the rear face of beam 42. Arm 61 has configured, lower, weighted flange portion 63 which normally holds plate 60 in the dotted line position of FIG. 3 with arm 61 vertical. However, an elongate vertical shaft 64 is provided rigidly mounted on base 32, having an upper beveled edge which, as beams 39 and 40 move downwardly into the fully based position of FIG. 3, deflect arm 61 and base 63 counterclockwise to the position shown, with plate 63 free of the top of pin 57.

It is assumed that beams 39 and 40 will be based, as well as J section members 33 and 34 within channels 30 and 31, during any mounting or dismounting of a work member with respect to the couple. The couple basically comprises, as may be seen, in this specific embodiment, beams 39 and 40, beam 43 and the outboard lift attachments thereof (comprising secondary beam members 44 and 45), lower beam 42 and the locking pin 57. For any attachment, whatever its nature, either one of those previously listed or the conventional horizontal beams 46 and 47 seen, to be engaged and disengaged with the couple which has been described, it is only necessary that two sets of guide plates (51-54, inclusive) with connectors 55 and 56 therein be rigidly fixed onto the rearward face of the work member, properly sized, spaced apart and at a proper height for the engagement in question. If the pin lock on lower beam member 42 is also to be employed, then an engaging member such as flange 58 must also be provided fixed to the back of the work piece member.

If an entire array of work attachments is provided on the back wall, panels or faces thereof with the engaging means described, then the subject universal couple, mounted on any suitable vehicle, may move around from one work member to another, engaging each, carrying it to do the work required, then returning it to the storage place with disengagement by dropping means 39 and 40 to bottom position and then moving to and picking up another work attachment. There is no requirement whatsoever of the operator ever leaving the drive seat or his working position on the vehicle. Alternatively, if the lift mast assembly is fixed in any given one location, then all that is necessary is that the work piece members be moved to same and engaged therewith for lifting work as may be required and, then, lowered for disengagement and translation or movement of the work piece member away from the couple so another may be engaged therewith. Alternatively for a fixed location lift mast assembly or the equivalent, the lift mast assembly may be on a track or trolley which translates forwardly or rearwardly, laterally to either side or both. The only requirement is that the work piece member and couple be brought together, by whatever means, and engagement made for work (and disengagement made for replacement) of the first work piece member with another.

In this construction shown, one important feature is that the actual rear face of the work piece member is abutted directly against said edges 39*a* and 40*a* of the guide plates so the center of gravity of the work piece member is as close as possible to the lift mast system. Yet further, a top weight carrying and position determining engagement, specifically, connectors 55 and 56 on surfaces 44*c* and 45*c*, are well behind the front edges 39*a* and 40*a* of beams 39 and 40 for the greatest possible stability, sure vertical positioning, security and securement.

As most particularly seen in FIGS. 1, 2, 4 and 5, the drawings of FIGS. 1-5, inclusive show how the subject inventive attachment is not only adapted to receive any work piece member thereon, but also even that work piece member which is the universal mounting of the prior art, if this is desired. Additionally, my mounting of the two parallel, horizontal, slide engagement beams is just as advantageous, positionwise, with respect to beams 39 and 40 as the conventional attachment, utilizing like beams, is itself. That is, in the subject illustrated attachment, the back faces of beams 46 and 47 will abut directly against the front edges 39*a* and 40*a* of beams 39 and 40. This is exactly the same position as the welded or otherwise fixedly attached like beam members provided on like verticals in the conventional universal mounting. This description enables one to see an additional advantage of the subject system. Not only can it utilize the lateral slide engagements of the conventional universal mounting any time such are necessary, when they are not used, considerable weight savings are provided, because the beams 46 and 47 are then absent and the new attachment or couple weighs less. (Thus, the important portion attached to the lift mechanism and the portion attached to the attachment have their weight positioned behind the load weight space of the normal left device permitting the coupling to be added to a vehicle or lift mechanism without the additional weight of the functioning coupling added to the lifting or working capacity of the lift mechanism.)

In the specific FIGS. 2 and 5, conventional lift hooks 65 and 66 have, on the rearward sides thereof, flange beam engagements 65*a* and 65*b* on lift hook 65 and 66*a* and 66*b* on hook 66. In conventional manner (not shown) locking means are provided to fix the lateral position of the lift hooks on the horizontal beams 46 and 47 once they have been slid thereon.

FIGS. 6–10, INCLUSIVE

Figure 6:
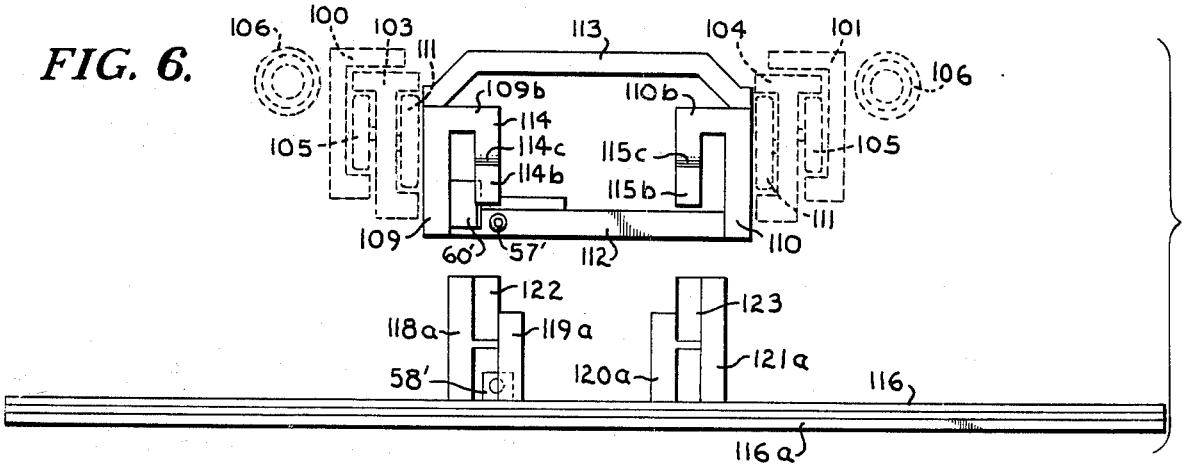

FIGS. 6–10, inclusive show a narrow gauge or smaller couple and attachment construction. The inventive construction is shown, as was the case in FIG. 1–5, inclusive, associated with a conventional lift mast construction. The lift couple, as noted before, may be either static or mobile. Fixed, static channel members 100 and 101 are normally vertical. These comprise essentially foreshortened C members, as seen in FIG. 6, in section and are rigidly tied to the base of the vehicle or any supporting surface. Such supporting surface or vehicle floor is normally horizontal and seen in FIG. 8 at 102. Nested within channel members 100 and 101 are J section members 103 and 104, which are vertically movable with respect to base 102 and fixed channel members 100 and 101. Rollers 105 are mounted on either the J section members 103 and 104 or channels 100 and 101 (or both). A pair of hydraulic cylinders 106 having vertically movable piston rods 107 are provided, placed as desired, but here shown laterally of fixed vertical channels 100 and 101. Optionally, a single hydraulic cylinder analogous to 36 in FIGS. 1 and 3 may be employed, per se or in conjunction with cylinders 106. Base or floor 102 may be carried by wheels 108 (FIG. 7), or be statically positioned or yet itself represent a floor.

All of the structures just described are essentially conventional in the prior art.

The particular improved couple construction of these figures is based upon elongate, normally vertical, generally substantially rectangular couple guide plate beams 109 and 110. Rollers 111 are typically rotatably mounted on the outer faces of beams 109 and 110 and operate to permit guide plate beams 109 and 110 to move upwardly and downwardly within J sections 103 and 104. This is analogous to rollers 105 permitting J sections 103 and 104 to move upwardly and downwardly within fixed channels 100 and 101.

Beams 109 and 110 are preferably tied together adjacent the lower ends thereof by the lower, normally horizontal, couple stabilizer beam 112. Beam 112 extends between the opposed, inboard faces of guide plate beams 109 and 110 and is connected thereto with its ends preferably near to the guide plate beam front edges in order that, preferably, the outboard surface or beam 112 is substantially in line with the front edges 109*a* and 110*a* of beams 109 and 110. An upper beam member generally designated 113 is rigidly welded or otherwise fixedly attached to the upper rear edges of beams 109 and 110 and extends therebetween.

By virtue of beams 112 and 113 rigidly locking guide plate beams 109 and 110 together in a vertical, parallel relationship, beams 109 and 110 move vertically upwardly and downwardly as a single unit. Beams 109 and 110, J sections 103 and 104 and channel sections 100 and 101 operate in conjunction with one another as a lift mast system. The hydraulic cylinders 106 may be tied to guide plate beams 109 and 110, directly, by structural connections (not seen), to lift them within J members 103 and 104 and also the latter with respect to channels 101 and 100. Alternatively, the hydraulic cylinders 106 may be connected to the J members to lift them with a secondary cylinder (not shown) carried by the J members to raise and lower the beams 109 and 110 with respect thereto.

Said otherwise, the drive means to raise and lower the lift mast elements with respect to one another and the base 32 are conventional and may be of any of the variously available sorts, types and structures. In the described cases and other arrangements, suitable stops (not shown) are provided with respect to rollers 111 with respect to the J members 103 and 104 and rollers 105 with respect to the J members and stationary channels 100 and 101. Thus, the roller, guide and stop means, as well as the power elements (hydraulic cylinders) between the noted mast elements permit telescoping, controlled, raising and lowering of the inner beams 109 and 110 and J members 103 and 104 with respect to one another and the fixed channels 100 and 101. These are conventional and may be of various known structures and thus are not detailed other than the showings and descriptions made.

As previously stated with respect to the construction of FIG. 1–5, inclusive various other described options of conventional mast design may be employed. The guide plates 109 and 110 may be directly positioned within stationary channels 100 and 101. Alternatively, additional mast sections other than movable guide beams and J sections may be provided for various high lift applications. In all such cases, suitable conventional engagements, including roller mountings and stops, are provided between the mast elements and the base channel sections. Various combinations of lift means are provided for various sections of the mast with respect to one another to meet the demands of high or low lifts and movement of various sections of the lift mast with respect to one another.

Each inner beam 109 and 110 has mounted inboard thereof and adjacent thereto respective secondary beam members 114 and 115. Secondaries 114 and 115 are rigidly secured, by the rear edges thereof, to the rear edges of beams 109 and 110. These securements are stub connections **109*b* and 110*b*. The top rearward edges of secondaries 114 and 115 are preferably in line with the tops of guide beams 109 and 110 and the top of connector 113. The forward edges 114*a* and 115*a* of secondaries 114 and 115 are preferably positioned at least in line with the forward edges 109*a* and 110*a* of the guide beams, but preferably therebehind as illustrated. The forward top edges of secondaries 114 and 115 preferably have raised forward portions 114*b* and 115*b*, respectively, these portions preferably having arcuate rearward bearing edges 114*c* and 115*c*** for purposes to be described.

In the prior art conventional use (not illustrated) of guide plates 109 and 110, typically, a pair of horizontal, vertically spaced apart beam members are fixed to the forward edges **109*a* and 110*a* of beams or plates 109 and 110. Such conventional, nonillustrated supporting horizontal beam members are provided with elongate, flanged upper and lower edges to permit work members of various sorts to be engaged therewith by sliding connection onto the beams from one side edge thereof while later removable therefrom in the same way. Such work members would include forks, rotators, clamps, etc. of the sort previously listed. To permit such prior art conventional engagement, the work member rear walls or faces are usually provided with spaced, horizontal, matching flanges mounted thereon which would be slidably engageable with the beam member upper and lower edges. The noted beam members could be a single plate like plate 116 of FIGS. 6–10**, inclusive to be described.

Figure 7:
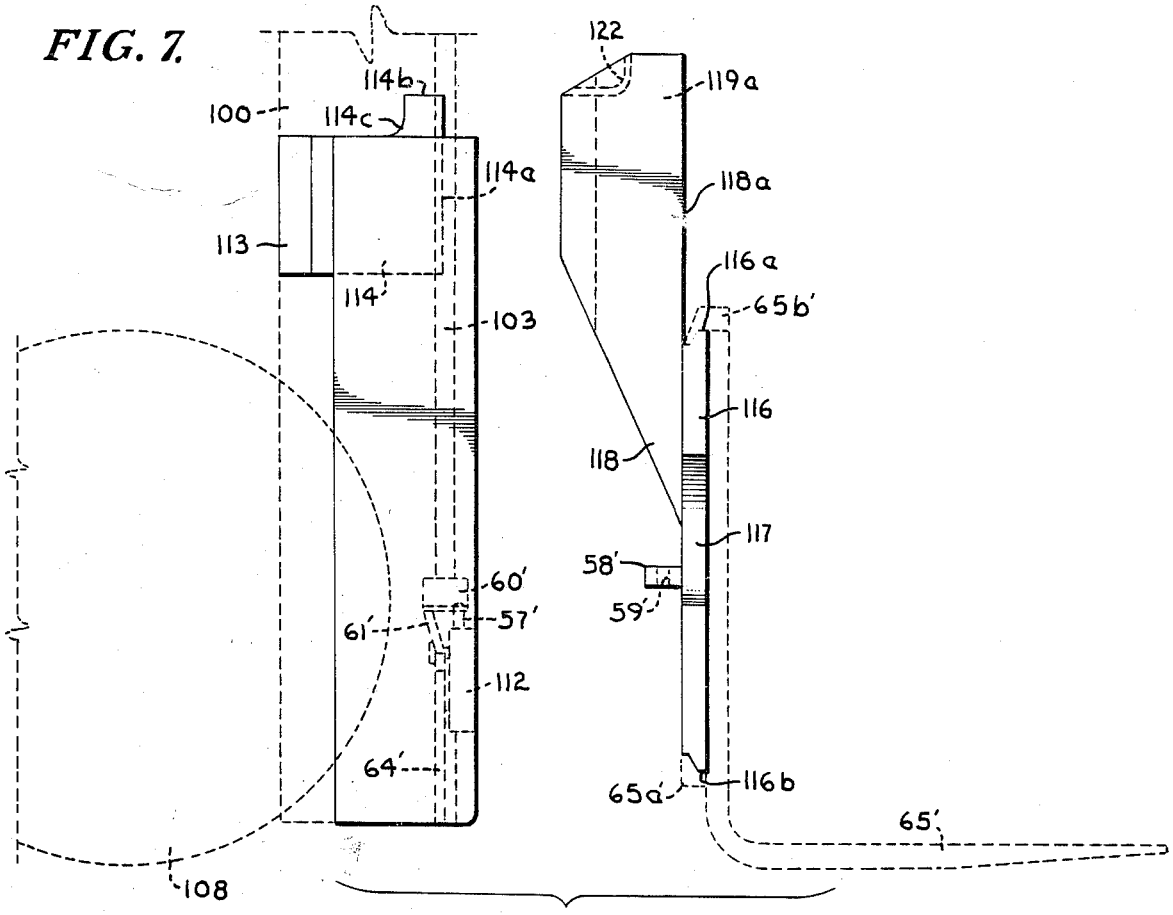

In the showings of these FIGS. 6–10, inclusive, referring at this moment to the attachment seen in the left hand side of FIG. 10 for engagement with the couple just described, a universal mounting comprising a single, normally vertical plate member 116 is shown. Thus, the attachment which will be described for these figures, particularly seen in full lines in the lower portion of FIG. 6, right hand portion of FIG. 7, FIG. 9 and right hand portion of FIG. 10, is not a working device of the sort listed above. Rather it is itself one prior art conventional mounting (in a modified form thereof somewhat varied from the showing of FIGS. 1–5). Only in the dotted line showings of FIGS. 9 and 7 are an actual work member shown on the couple. The particular attachment which is to be described is selected for simplicity and ease in illustration, itself representing the rear wall of the work member for descriptive purposes. Thus, the particular attachment shown is selected to enable effective illustration of engaging and disengaging of the subject couple with a typical attachment or portion of the latter.

Referring, then, to FIGS. 9 and 10, the right side of the latter, an elongate, essentially rectangular plate 116 is provided having end cut-outs 117 and 118 for weight conservation. Plate 116 also has top mounting flange **116*a* and bottom mounting flange 116*b* extending the horizontal length of the top and bottom edge thereof, respectively. These flanges are for slidable mounting purposes for mounting and removing work attachments, as will be described, such shown as lift hooks in FIGS. 7 and 9. The purpose of plate 116 is the same as beams 46 and 47 in FIGS. 1–5, incl., rigidly attached to one another and spaced apart by members 48 and 49. Thus, the prior art universal mounting system may be provided by plate 116 or beams 46 and 47 being directly and rigidly fixed to the front edges of the guide plate beams (109*a* and 110*a* or 39*a* and 40*a***, respectively).

One may raise the question with respect to the showings of FIGS. 1–5, inclusive and 6–10, inclusive as to why one would ever want to employ the prior art universal mounting construction of horizontal beams or horizontally oriented vertical plate, when such can be supplied directly on the guide plate beam front edges noted. The answer to this is that one prefers not to have to supply an attachment with the prior art universal mounting but, where such is available, it may be used to engage with work piece members which already have mountings fixed thereto for the old conventional system. It is far more preferred to omit the horizontal beams or plates of the old prior system entirely and fix the attachment members to be described directly onto the work member, thus achieving the advantages previously discussed with respect to the earlier described form of FIGS. 1–5 incl. and to be noted with respect to this modification.

What is required of any work piece member which is to be carried by the couple on beams 109 and 110 is that it have a normally vertical rearward face of such dimension as to be able to extend between and across and abut against the forward edges of beams 109 and 110. Said otherwise, the rearward, normally vertical face or wall of the work member will be carried in abutment against the front edges 109*a* and 110*a* of beams 109 and 110 while that work member is suspended from or carried by the secondary beam members 114 and 115 inboard of beams 109 and 110, once the couple and the attachment are engaged or mated.

In order to provide suitable engaging suspension means for such work member (here illustrated as plate 116 but optionally any of the working devices previously listed or others), two sets of normally vertical, paired work piece support plates are fixed to the rearward wall or face of the member (here plate 116) extending normally thereto. The lower part of FIG. 6, the right hand side of FIG. 7, FIG. 9 and the right hand side of FIG. 10 show such plates which comprise a first set 118 and 119 (their lower ends attached to plate 116) and a second set generally designated 120 and 121 in their portions attached to plate 116. These sets are normally vertical and parallel to one another with the internal members of the sets being parallel to one another. The centers of the sets of the plates are spaced apart from one another a distance equal to that separating the centers of secondary beam members 114 and 115. The two support plates of each set (118 and 119 of one set and 120 and 121 of the other set) are spaced apart from one another a distance greater than the thickness of the secondaries 114 and 115, whereby, when the couple, basically including the lift mast assembly and secondary beams 114 and 115, is moved toward the work piece member rear face, secondaries 114 and 115 may slidably engage between the sets of support plates.

Connectors generally designated 122 and 123 are provided at the upper ends of the respective plate sets and fixed therebetween. Connectors 122 and 123 are of congruent underside configuration to the shape of rear surfaces 114*c* and 115*c* of secondaries 114 and 115. The upper portions 118*a*–121*a* of plates 118–121 are made considerably deeper compared to the lower portions thereof connected to the work member rear wall face. The upper engaging members or connectors 122 or 123 are so positioned with respect to the rearmost face of the work member 116 that, when said rear face of work member 116 is in abutment against the forward edges 109*a* and 110*a* of the respective beams 109 and 110, connectors 122 and 123 may overlie arcuate surfaces 114*c* and 115*c* and be mated therewith by vertical movement of beams 109 and 110 into tight, congruent, locking engagement.

It is important to note in both FIGS. 1–5, incl. and 6–10, incl. only one support plate is absolutely required in each set. Such would typically be either both outer or both inner plates with connectors 122 and 123 strong enough and strongly connected enough at their bases to carry the weight. The secondaries 114 and 115 need only provide a locking mounting surface for the connectors and need not be of any specific flat beam structure although the beam/engaging plate structure shown is optimum, strong, self guiding and stable.

The engagement just described is provided by lining up the front edges 109*a* and 110*a* of beams 109 and 110 and the lift mast system parallel to and centered of the ends of the rear face of work member 116. In this manner, secondaries 114 and 115 may be lined up for engagement between, respectively, support plates 118 and 119 and 120 and 121. Beams or plates 109 and 110 must be in such a lowered position that the high front secondary portions 114*b* and 115*b* are low enough to slip under connectors 122 and 123. Such described aligned and lowered relationship of secondaries 114 and 115 with respect to the attachment plates permits the secondaries to slide between the plates in the upper deep portions thereof whereby, when the rear face of plate 116 abuts against the guide beam front edges 109*a* and 110*a*, lifting the beams 109 and 110 by the hydraulic cylinders effects engagement of the upper faces of arcuate portions 114*c* and 115*c* with the undersides of the configured connectors 122 and 123. Disengagement of the couple from the attachment is made the opposite fashion with beams or plates 109 and 110 being lowered so that secondary beam portions 114*b* and 115*b* may clear under the lowermost portions of connectors 122 and 123 as the vehicle or other transport moves away or to the left in the views of FIGS. 7 and 10. In the event the lift mast is static, the work member and its attaching means must be pulled, lifted or otherwise moved away from the lift mast assembly.

As has been described with respect to the construction of FIGS. 1–5, inclusive, in many or most instances, it is desirable or necessary to provide a second engagement (other than that immediately described) between the couple and work member. In such case, a lower, second engagement may be provided in the precise same manner as has been previously described with respect to FIGS. 1–5, inclusive. In order to minimize description and duplication of text, suffice it to say that corresponding members (on lower transverse beam 112 between beams 109 and 110) to like members on beam 42 of FIGS. 1–5, inclusive (between beams 39 and 40) are numbered the same and primed. Such is also true with respect to the engagement on the rearward face of plate 116 compared to the engagement on the rearward face of member 48 of FIGS. 1–5, inclusive. The description of such parts and their operation is here incorporated in its entirety by reference.

The operation of this lower couple, being entirely the same as the lower couple in FIGS. 1–5, inclusive is thus not again described. Finally, the arming member 64 for the cover of pin 57 (see FIG. 3) is the same between these sets of views and it, again, is numbered the same in FIG. 8 as in FIG. 3, but primed. The lower couple is not always required to be provided, particularly if the lift mast system or its equivalent is static on a stable, horizontal ground surface or floor, with the lift truly vertical. In such case, the single upper mounting earlier described will, in most cases, suffice. This is true of the structure of FIGS. 1–5, inclusive also.

Where the mounting of the couple construction of the top portion of FIG. 6, left portion of FIG. 7, FIG. 8 and left hand portion of FIG. 10 is mobile, that is, mounted on a vehicle of some sort, then the new universal couple, with the engageable secondary beam members 114 and 115 and the optional lower connector on base beam 112 may move around the work and storage areas as may be required or desired. In a storage area, it is presumed that all of the work members have fixed to the rear wall or face thereof sets of plates 118–121, inclusive and, optionally, the lower connectors 58′. These must be mounted or positioned at a height and spacing to enable the secondary beam member's highest portions to pass under the connectors 122 and 123 when the work piece is at rest or in storage. If the secondary coupling is used, the vertical spacing of connectors 122 and 123 from connector 58′ must be the proper distance compared to the vertical spacing of the secondary beams and pin 57′.

In the circumstance that there are present some work attachments or work members which retain on their engaging (back) walls or faces prior art horizontal groove engagers, then it is necessary that there be provided in the storage yard or work area attachments of the sort seen in FIGS. 1–5, inclusive (horizontal beam engagers) or 6–10, (horizontal plate engagement) for engagement by the couple before attachment thereto. Thus the true versatility of this device is seen. It is optimally used with direct connection of a working attachment or member to the plates 51–54, inclusive or 118–121, inclusive, so the rear face of the work member abuts directly against the beam carrying the secondary beam members thereon. Alternatively, however, the old universal coupler may be interposed therebetween to accomodate old attachment mountings.

It is evident that beams 39 and 40 or 109 and 110 may be spaced apart from one another a distance such as is desired. The couple of FIGS. 1–5, inclusive, the wide couple or engagement, is employed with extremely large, wide or unstable working devices. The inboard secondary beam engagement section, as seen in FIGS. 6–10, inclusive, is employed with smaller, narrower and more stable working members.

The lift forks of FIGS. 7 and 9 being the the same as those of FIGS. 2 and 4, as well as the mounting and dismounting thereof, such are numbered the same, but primed. The description will not be repeated.

FIG. 11

FIG. 11 shows a couple construction analogous to that seen in FIGS. 1–5, inclusive (broad or wide gauge) wherein the mount or base for the couple, instead of being a transport, vehicle or the like, is a static, vertical lift hoist or frame. This couple is analogous to that seen in full lines of the top portion of FIG. 1, to the left hand side of FIG. 2, FIG. 3 and the left hand side of FIG. 5. It is a wide gauge couple construction adapted to receive, attach to and be detached from (and lift and lower) attachments such as that also seen in FIGS. 1–5, inclusive, specifically, the lower portion of FIG. 1, the right hand portion of FIG. 2, FIG. 4 and the right hand portion of FIG. 5. Since the attachment(s) would be the same, similar or analogous in structure to that shown in FIGS. 1–5, inclusive, such is not shown in FIG. 11.

At 300, there is seen a typical base support for the mast and (optional) power means for this couple, such optionally comprising a steel plate or the like. Alternatively, this couple could be fixed in concrete or be mounted on a wheeled base or platform. The same (mounting on a portable platform or base) is also the case with respect to the constructions seen in FIGS. 12 and 14. Vertically mounted on base 300, here at the side edges thereof, are two preferably square section masts 301 and 302 having front faces 301*a* and 302*a*. Masts 301 and 302 are spaced apart any desired or selected distance. In the case shown, they are spaced apart a greater distance on the base 300 than beams 39 and 40 are (from one another) in FIGS. 1–5, inclusive.

Two elongate, flat beams 303 (upper) and 304 (lower) are mounted on masts 301 and 302 by collar members 305 (upper) and 306 (lower). The beams 303 and 304 constitute one portion of the collars frictionally but slidably enclosing masts 301 and 302. An elongate, vertical plate or connecting beam 307 is rigidly fixed by welding or bolting to the rear faces of horizontal beams 303 and 304 and rigidly connect the two together for vertical movement up and down in concert.

A rearwardly extending, normally horizontal plate or platform 308 is fixed to the back surface and upper edge of beam 303 or formed integrally therewith, whereby to have attached thereto the means for powering and moving the couple assembly in up and down motion on masts 301 and 302. A first option of such power is cable 309 which is optionally fixed through an opening in plate 308 or to the upper surface thereof and is driven by any suitable prime mover, such as an electric motor. Alternatively, an hydraulic pneumatic cylinder 310 may be mounted on base 300 with piston rod 311 powered thereby. Suitable conventional hydraulic or pneumatic connections (not seen) are provided to cylinder 310 to extend and retract rod 311 with respect thereto. The top of rod 311 may be welded or otherwise fixedly attached to plate 308.

Outboard of outer beam 302 there are provided engaging arms or elements analogous to elements 43*a*, 44, 44*a*, 44*b* and 44*c*, as well as 43*b*, 45, 45*a*, 45*b* and 45*c* of FIGS. 1–5, inclusive. That is, outwardly extending and rearwardly angled beam extensions 312 and 313 on the outboard ends of beams 303 have vertical ends or extensions 314 and 315 thereon extending parallel to beams 303 and 304 with forwardly extending elements or members 316 and 317 normal to beams 303 and 304 fixed to the outer ends thereof. Upwardly extending end engaging elements 318 and 319 are likewise provided. The forward extension of elements 316 and 317 may be so as to place the forward edges 316*a* and 317*a* of member 316 and 317 forward of, flush with or rearward of the front faces of beams 303 and 304. FIG. 1 shows, as does FIG. 2, such members placed rearwardly of the forward face of beam 43. In the present case, the alignment is substantially flush with front face of beam 303. This placement depends on how far back of the face of the main support beam the engagement is desired for center of gravity and weight purposes. Preferred are flush or rearward of the main beams 303 and 304 faces.

In use, an attachment the same, similar or analogous to the attachments of the previous figures are provided. Referring to FIG. 10, the engaging beams 118*a*, 119*a*, 120*a* and 121*a* are located much too close together for FIG. 11, but the principle is the same and the work piece 116 could be the same. In FIG. 5, the work piece members 46, 47, 48 and 49, may be the same, but, again, the engagement arms 51*a*, 52*a*, 53*a* and 54*a* and the engagement plates 55 and 56 (which would overlie the upper faces of members 316 and 317 behind upwardly extending elements 318 and 319) would be further apart than seen in FIG. 5. Alternatively, as previously noted with respect to the other figures, the work pieces may be the rear faces or walls of any of the listed work members previously designated or any standard work member, as opposing to the mounting elements seen in FIG. 5 and 10 which are quite conventional with the trade (and illustrated only for simplicity's sake). Preferably, that is, the mounting arms 51*a*–54*a*, inclusive or 118*a*–121*a*, inclusive are directly mounted on the working element, not a support therefor.

In any case, unless the platform 300 is mounted on a portable transport, typically, then, the work piece, with its mounting arms, will be moved to the base 300 with the beams 303 and 304 in lowermost position for mounting the engaging plates on the attachment support arms over the members 316 and 317 behind elements 318 and 319 as was the case previously described with respect to the other figures.

With respect to this device, a locking means may be provided the same, similar or analogous to those seen with respect to FIGS. 1–10, inclusive. Here the post 320 is provided on the top edge 304*a* of the beam 304 with the cover 321 (see element 60) carried by member 322 pivotally mounted on shaft 323 (see elements 61 and 62 of FIGS. 1–5, inclusive) on the rear face of beam 304. The deflector member 324, which operates in the same manner as member 64 in FIG. 3 to clear plate 321 from post 320 when the assembly is in lowermost position, is mounted on base 300.

FIGS. 12 AND 13

FIGS. 12 and 13 show a variation in the subject invention where a narrow gauge couple (analogous to the showing of FIGS. 6–10, inclusive) is associated or employed with a double or two mast lift arrangement. As in the case of FIGS. 11 and 14, this assembly can be mounted on a portable or transportable bed or structure. However, it is, more typically, a static mounting with the attachment being moved to and away from the couple, rather than vice versa.

Referring, then, to FIG. 12, at 400 there is seen a strong, flat, horizontal base 400 which may be, for example, a steel plate and, further, optionally may be mounted on some sort of transportable or movable vehicle. Vertically mounted on base 400 are two spaced apart, optionally square section masts 401 and 402 having front faces 401*a* and 402*a*, respectively. In the case of the dual or paired mast versions of FIGS. 11 and 12, the utilization of square or rectangular section masts, is not as important as is such use with a single mast as in FIG. 14, but is preferred. Masts 401 and 402 may be spaced as far apart (or closely together) as desired and permitted by the structure to be described. In the version shown, the spacing of the couple upper grab elements (to be described) is further apart than elements 114 and 115 of the construction of FIGS. 6–10, inclusive (also an inboard arrangement), but closer together than the engagement or grab elements 44 and 45 of the outboard version of FIGS. 1–5, inclusive.

Lower beam 403 overlies the front faces 401*a* and 402*a* of mast 401 and 402 and extends therebetween. It is mounted thereon by encirclements or cages 404 and 405 of which the outer extremities of beams 403 form the front face or side. The encirclement or engagement is frictional, but readily slidable. Extending upwardly from the preferred center of beam 403, on the top edge thereof, is member 406 which is normally vertical, as opposed to the normally horizontal extended beam 403 and in the same vertical plane as beam 403.

To the upper end of member 406 there is attached or made integral plate 407 which is here shown as rectangular in form and positioned in the same vertical plane as beam 403 and member 406. To the rear face of plate 407 is welded or otherwise fixedly attached platform 408 which extends normal to the plane of FIG. 407 in horizontal orientation. To plate 408, in order to lift and lower the couple assembly being described, there may be attached cable 409 or the piston rod 410 of an hydraulic or pneumatic cylinder 411 rigidly mounted centrally of base 400. Suitable hydraulic or pneumatic attachments (not shown) are made to cylinder 411. If cable 409 is employed, a suitable prime mover is connected to the upper end thereof to permit lifting and lowering of the couple assembly being described, to the outboard ends of plate 407 are U-shaped constructions (in plan view) comprising U leg members 412–415, inclusive and U base members 416 and 417. Rigidly connected to or formed integral with U outboard legs 412 and 415 are outboard beam members 418 and 419 which lie against the forward faces 401*a* and 402*a* of mast 401 and 402 in the plane of beam 403, member 406, and plate 407. Encirclements or collars 420 and 421 are connected to beams 418 and 419, of which the latter form the front portion.

Fixed to the U member bases and extending normal thereto are engaging members 422 and 423 having upwardly extending outer ends 424 and 425. The outermost ends of members 422 and 423 are shown recessed back of the front faces of plate 407 and beams 418 and 419, but they may be flush therewith or extend somewhat outwardly therebeyond. The preferred arrangement is that shown for center of gravity and weight distribution effects.

The operation of the construction of FIGS. 12 and 13 is the same as that of the construction of FIGS. 6–10, save the former is usually static. That is, an attachment (such as that seen to the right in FIG. 10, below in FIG. 6, to the right in FIG. 7 and in FIG. 9, with the engaging beams 118*a*–121*a* having the engaging plates 122 and 123 separated on the work member 116 to register with engaging members 422 and 423) is transported to the couple construction of FIG. 12 when the same is in its lowermost position. This may, as may be the case in FIGS. 11 and 14, be where the bottom face of beam 403 (or beams 304 or 206) actually rests on base 400 (200, 300). When the attachment is engaged with plates 122 and 123 overlying and positioned behind upwardly extending ends 424 and 425, with the lock engagement (not seen in FIGS. 12 and 13) also engaged, if present and with the inner face of work member 116 lying against member 406 and beam 403, the operator lifts the couple via cable 409 or piston rod 410 to perfect the engagement and lift the attachment free of any carrier. The work assembly then may be used for whatever task it is designed.

If the assembly of FIGS. 12 and 13 is portable, it may be moved to the attachment in the manner previously described with respect to the constructions of FIGS. 1–10, inclusive.

Thus it may be seen that either the subject couple or the attachment may be portable. The couple may be vehicle, floor or base mounted. The work attachment, as previously stated in great detail, is typically not the simple mounting plate 116 (FIGS. 6–10, inclusive) or the bar mounting means 46 and 47, but, preferably, and most typically, an actual working device having the attachment supports directly connected to the rearward, nonoperating face or walls thereof. In the case of mast mounting, the masts may be one in number or plural, as seen in FIGS. 11–15, inclusive.

FIG. 14 STRUCTURE AND FUNCTION

FIG. 14 shows a modified couple associated with a vertical mast support system. The constructions of FIGS. 11 and 12 show, respectively, wide gauge and narrow gauge couples on dual or double mast support or guide systems, FIG. 11 showing the wide gauge couple in such mounting and FIG. 12 showing the narrow gauge couple in such mounting. FIG. 14 is adaptable to either a narrow gauge or wide gauge coupling (within certain limits), but does not have the basic strength and stability of the double mast constructions of FIGS. 11 and 12.

In FIGS. 14 and 15, base 200 may be of any desired size and shape, but here is shown as a rectangular plate (of steel or other exceedingly strong material) with rearward extension 201. Mast 202, preferably of square section, is rigidly fixed at its lower end to base 200. Slidably (yet closely and frictionally) engaging mast 202 are two hollow, square collars designated 203 (upper) and 204 (lower). Forming the front wall of upper collar 203 is normally vertical flat plate or beam 205. Fixed to and constituting the front face of lower collar 204 is normally vertical, here rectangular plate 206. Plates 205 and 206 are preferably of equal thickness and substantially equal height and width, with plate 206 more often of greater width. They are connected by an elongate flat beam 207 which lies against the front face 202*a* of mast 202 in the same manner as the similar portions of plates 205 and 206.

Rigidly fixed to or integral with collar 203 is normally horizontal, rearwardly extending plate or platform 208. In the event that the couple is driven in vertical up and down motion by hydraulic means, hydraulic cylinder 209 is provided rearward of mast 202 mounted on extension 201 of base 200 with piston rod 210 extending upwardly therefrom and connected (not shown) to the underside of platform 208. Alternatively, a cable or rod 211 may be fixed to (typically through an opening therethrough) platform or plate 208 for lifting and lowering purposes. Suitable hydraulic or air pressure connections are provided to cylinder 209 and a suitable power source as an electric motor or other prime mover to cable 211.

The couple arm engaging means outboard of plate 205 are the same, similar or analogous to those seen in FIGS. 1–5, inclusive, particularly at 43*a*, 44, 44*b* and 44*c* and 43*b*, 45, 45*a*, 45*b* and 45*c*. Thus, outwardly and rearwardly angled beam portions 212 and 213 have, at the outboard ends thereof, extensions 214 and 215 parallel to plates 205 and 206. Forwardly extending arms or extensions 216 and 217 are normal to front face 202*a* of mast 202 and plates 205 and 206. Upwardly extending engaging ends or members 218 and 219 are provided at the forward and upper ends of members 216 and 217. The configurations of the members 212–219, inclusive may very closely resemble those of the like parts of FIGS. 1–5, inclusive, specifically, rounded and faired, rather than angled and straight.

It may readily be seen that this couple may engage the attachment members of constructions such as those seen to the right in the views of FIGS. 5 and 10 or, to be more detailed, the lower portions of FIGS. 1 and 6, right hand portions of FIGS. 2 and 7, as well as FIGS. 4 and 9. The only difference, in the configurations illustrated, is that the engaging means on the work pieces, for the construction seen in FIG. 14, would be closer together (plates 55 and 56) than seen in FIG. 4 and further apart (plates 122 and 123) than in FIG. 9. The spacing of the overlying engaging plates 55 and 56 or 122 and 123 with respect to the depth of the arms carrying them must be such that the rear face of the work (members 46 and 47 in FIGS. 1–5, inclusive and plate 116 in FIGS. 6–10, inclusive) will lie flat and vertical against the plate 206, when the couple is engaged with the attachment in the manners previously described with respect to FIGS. 1–10, inclusive.

In the case of the construction of FIGS. 14 and 15, of course, it is necessary that the attachment be brought to, raised over and moved toward the couple arms 216 and 217 and then lowered for engagement. That is, the transport is generally associated with the attachment in the construction of FIG. 14, rather than vice-versa as is the case with the constructions of FIGS. 1–10, inclusive, typically. Once the attachment is engaged with the couple in FIG. 14, the drive of the hydraulic or pneumatic cylinder 209 or the pull of cable 211 will raise and lower the coupled attachment to whatever position is desired for the working purpose. When it is desired to remove the attachment (such as replace it with another), the couple is lowered to its lowermost position, suitable transport and engaging means is moved to the attachment, such is lifted and pulled away from the couple.

Alternatively, if base 200 is mounted on transport means or a suitable vehicle, the couple of FIG. 14 may be moved with respect to the attachments as described with respect to FIGS. 1–10, inclusive.

A lock is not seen on the construction of FIG. 14. However, an identical lock to that seen in FIGS. 1–10, inclusive may be employed with the post 57, 57′ on the upper edge or face 206*a* of plate 206, the rocking cover 60, 61, 63 (60′, 61′, 63′) on pivot 62, 62′ on the rear face of plate 206 with the deflecting bar 64, 64′ mounted on the upper face of base 200. With such lock, the same loop engagement 58, 58′, with passage 59, 59′ therein, is provided on the rear face of the attachment, as is seen in the previous FIGS. 1–10, inclusive.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A quick lift couple and attachment comprising, in combination:

(1) a couple construction made up of:

(a) a pair of elongate, normally vertical couple guide plate beams, (b) said couple guide plate beams opposed to one another in parallel, spaced apart relationship and being substantially rectangular in side, front and plan views, (c) said beams having forward and rearward edges, top and bottom ends and inboard and outboard elongate flat faces, (d) a lower, normally horizontal couple stabilizer beam extending between the opposed inboard faces of said couple guide plate beams adjacent the lower ends thereof and connected thereto with its ends near to the guide plate beam's front edges so that one surface of the stabilizer beam is substantially in line therewith, (e) an elongate, normally horizontal couple top support beam fixed to the front edges of said couple guide plate beams adjacent the top ends thereof with a center portion thereof and extending, with outer portions thereof, laterally past the guide plate beams, (f) the outer portions of the couple top support beam, in plan view, on each side of the couple guide plates, angling rearwardly of the center portion thereof with the outermost end portions thereof extending forwardly substantially parallel to said guide plates but ending rearwardly of the forward face of the center portion of said top suppport beam.

(2) an attachment for such couple made up of:

(a) a work piece member having a normally vertical rearward face of such dimension as to extend between and across and be able to abut against the forward edges of the said couple guide plates below said couple top support beam in a position normal to the said guide plates, (b) two sets of normally vertical, paired work piece support plates fixed to the rearward face of said work piece member and extending normal thereof, (c) the centers of the sets of such work piece support plates spaced apart from one another a distance equal to that separating the centers of the outermost end portions of the couple top support beams and the two support plates of each set spaced apart a distance slightly greater than the distance of said outermost end portions, whereby, when the couple is moved toward the work piece member rear face the outermost end portions of the couple top support beam may engage between the members of the sets of support plates and (3) means cooperating between the couple top support beam endmost portions and the upper portions of the sets of support plates for revovably engaging the one with the other behind the forward edges of the couple guide plates and raising and lowering the said support plates and attached work piece when said guide plates are raised and lowered.

2. A couple and attachment as in Claim 1 including means cooperating between the rearward face of the said work piece member and said couple stabilizer beam for removably engaging a portion of the work piece below the tops of the support plates thereon with the said couple stabilizer beam when said top support beam and portions and upper portions of the sets of support plates are engaged, one with the other.

3. A couple and attachment as in Claim 2 wherein means fixed between the upper portions of the panel support plates overlie the outermost end portions of the couple top support beam and, additionally, the means cooperating between the rearward face of the work piece member and the couple stabilizer beam overlie the latter when the couple and attachment are engaged.

4. A couple and attachment as in Claim 1 wherein the work piece comprises a pair of normally horizontal, vertically spaced apart beam members adapted to receive other attachments mounted thereon.

5. A couple and attachment as in Claim 1 wherein the last cooperating means comprises raised top portions on the forwardmost couple top support beam end portions and configured plates fixed between the members of said sets of work piece support plates adjacent their upper ends adapted to overlie the couple top support beams inboard of said raised top portions.

6. A couple and attachment as in claim 1 wherein the work piece support plates are of a height substantially that of the couple guide plates and are substantially deeper in their upper portions.

7. A couple and attachment as in claim 1 wherein the last cooperating means comprises means on said support plates overlying and removably engaged with means on said secondary beam members.

8. A couple and attachment as in claim 1 including second means cooperating between the rear face of said work piece member and said couple stabilizer beam for removably engaging a portion of the work piece with said couple stabilizer beam below the engagements of the support plates with the secondary beam members when the secondary beam members and upper support plates are engaged, one with the other.

9. A quick lift couple and attachment comprising, in combination:

(1) a couple construction made up of:

(a) a pair of elongate, normally vertical couple guide plate beams, (b) said couple guide plate beams opposed to one another in parallel, spaced apart relationship and being substantially rectangular in side, front and plan views, (c) said guide plate beams having forward and rearward edges, top and bottom ends and inboard and outboard elongate flat faces, (d) a lower, normally horizontal couple stabilizer beam extending between the opposed inboard faces of said couple guide plate beams adjacent the lower ends thereof and connected thereto with its ends near to the guide plate beam front edges so that one surface of the stabilizer beam is substantially in line therewith, (e) each guide plate beam, adjacent the top end thereof, having mounted inboard thereof a secondary beam member positioned substantially parallel to the guide plate, the secondary beams and guide plate beams secured to one another adjacent the rearward edges thereof, (2) an attachment for said couple made up of:

(a) a work piece member having a normally vertical rearward face of such dimension as to extend between and across and be able to abut against the forward edges of said couple guide plates below the top ends thereof and in a position normal to the said guide plates, (b) two sets of normally vertical, paired work piece support plates fixed to the rearward face of said work piece member and extending normal thereto, (c) the centers of the sets of such work piece support plates spaced apart from one another the distance separating the centers of the secondary beam members and the two support plates of each set spaced apart a distance slightly greater than thickness of said secondary beam members, whereby, when the couple is moved toward the work piece member rear face, the secondary beam members may engage between the members of the set of support plates, and (3) means cooperating between the couple secondary beam members and the upper portions of the sets of support plates for removably engaging the one with the other behind the forward edges of the couple guide plates and raising and lowering the said support plates and attached work piece member when said guide plates are raised and lowered.

10. A couple and attachment as in claim 9 including means cooperating between the rearward face of said work piece member and said couple stabilizer beam for removably engaging the portion of the work piece